US009097475B2

(12) United States Patent
Ricks

(10) Patent No.: US 9,097,475 B2
(45) Date of Patent: Aug. 4, 2015

(54) GAS-OPERATED FIREARM WITH PRESSURE COMPENSATING GAS PISTON

(71) Applicant: RA BRANDS, L.L.C., Madison, NC (US)

(72) Inventor: Jonathan Ricks, Cecilia, KY (US)

(73) Assignee: RA Brands, L.L.C., Madison, NC (US)

( * ) Notice: Subject to any disclaimer, the term of this patent is extended or adjusted under 35 U.S.C. 154(b) by 0 days.

(21) Appl. No.: 13/799,786

(22) Filed: Mar. 13, 2013

(65) Prior Publication Data

US 2014/0150638 A1 Jun. 5, 2014

Related U.S. Application Data

(60) Provisional application No. 61/797,420, filed on Dec. 5, 2012.

(51) Int. Cl.

| | |
|---|---|
| ***F41A 5/26*** | (2006.01) |
| ***F41A 5/22*** | (2006.01) |
| ***F41A 5/28*** | (2006.01) |
| ***F41A 5/18*** | (2006.01) |

(52) U.S. Cl.
CPC ... *F41A 5/22* (2013.01); *F41A 5/18* (2013.01); *F41A 5/26* (2013.01); *F41A 5/28* (2013.01)

(58) Field of Classification Search
CPC ..... F41A 5/18; F41A 5/20; F41A 5/22; F41A 5/26; F41A 5/28
USPC ..... 89/191.01, 191.02, 193, 194
See application file for complete search history.

(56) References Cited

U.S. PATENT DOCUMENTS

| | | | | |
|---|---|---|---|---|
| 1,877,118 | A * | 9/1932 | Barnes | 89/42.01 |
| 2,987,967 | A * | 6/1961 | Wild et al. | 89/193 |
| 3,020,807 | A | 2/1962 | Hailston at al. | |
| 3,568,564 | A | 3/1971 | Badali | |
| 3,601,002 | A * | 8/1971 | Janson | 89/191.02 |
| 3,968,727 | A | 7/1976 | Hyytinen | |
| 3,990,348 | A | 11/1976 | Vesamaa | |

(Continued)

FOREIGN PATENT DOCUMENTS

EP 0158707 A2 10/1985

OTHER PUBLICATIONS

Jacob Gottfredson, Standing ready: Sig Sauers 516 patrol rifle, Guns Magazine, Mar. 1, 2012, pp. 68-70, vol. 58, issue 3, Publishers Development Corporation.

(Continued)

*Primary Examiner* — Stephen M Johnson
(74) *Attorney, Agent, or Firm* — Womble Carlyle Sandridge & Rice, LLP

(57) ABSTRACT

A gas operating system for a firearm renders the firearm capable of firing a wide range of shot loads by passively or automatically compensating for different shot loads. The firearm includes a plurality of ports formed in the firearm barrel, and corresponding ports formed in a gas block of the gas operating system. The ports tap gases generated during firing which are used to cycle the firearm. When firing different cartridge loads, differing combinations of the ports are selectively at least partially blocked or otherwise obstructed by the cartridge casing according to the size of the cartridge. Additionally, the gas operating system includes compensating gas pistons with internal relief valves that can bleed off excess gas to compensate for larger shot loads regardless of the size of the cartridge.

18 Claims, 8 Drawing Sheets

(56) References Cited

U.S. PATENT DOCUMENTS

| | | | | |
|---|---|---|---|---|
| 4,085,654 | A * | 4/1978 | Panigoni | 89/191.02 |
| 4,102,243 | A | 7/1978 | Jennie | |
| 4,125,054 | A | 11/1978 | Jennie | |
| 4,174,654 | A | 11/1979 | Liedke | |
| 4,373,423 | A | 2/1983 | Moore | |
| 4,389,920 | A | 6/1983 | Dufour, Sr. | |
| 4,414,880 | A | 11/1983 | Throner | |
| 4,702,146 | A | 10/1987 | Ikeda et al. | |
| 4,872,392 | A | 10/1989 | Powers et al. | |
| 4,901,623 | A | 2/1990 | Lee | |
| 5,218,163 | A | 6/1993 | Dabrowski | |
| 5,272,956 | A | 12/1993 | Hudson | |
| 5,388,500 | A | 2/1995 | Petrovich | |
| 5,429,034 | A * | 7/1995 | Badali et al. | 89/193 |
| 5,959,234 | A | 9/1999 | Scaramucci et al. | |
| 6,374,720 | B1 | 4/2002 | Tedde | |
| 6,508,160 | B2 | 1/2003 | Beretta | |
| 6,619,592 | B2 * | 9/2003 | Vignaroli et al. | 89/191.01 |
| 6,715,396 | B2 | 4/2004 | Dionne | |
| 6,971,202 | B2 | 12/2005 | Bender | |
| 6,973,863 | B1 | 12/2005 | Jones | |
| 7,258,056 | B2 | 8/2007 | Guesnet et al. | |
| 7,343,844 | B2 * | 3/2008 | Poff, Jr. | 89/198 |
| 7,810,423 | B2 | 10/2010 | Monroe | |
| 7,856,917 | B2 | 12/2010 | Noveske | |
| 7,891,284 | B1 | 2/2011 | Barrett | |
| 7,926,404 | B2 | 4/2011 | Brittingham | |
| 7,942,090 | B1 | 5/2011 | Hoffman | |
| 7,946,214 | B2 | 5/2011 | Stone | |
| 8,042,448 | B1 | 10/2011 | Sylvester et al. | |
| 8,065,949 | B1 | 11/2011 | Molinari | |
| 8,161,864 | B1 | 4/2012 | Vuksanovich | |
| 8,201,489 | B2 | 6/2012 | Juarez | |
| 8,245,625 | B2 | 8/2012 | Winge | |
| 8,250,964 | B2 | 8/2012 | Stone | |
| 8,261,653 | B2 | 9/2012 | Crommett | |
| 8,316,756 | B1 | 11/2012 | Woodell et al. | |
| 2005/0115398 | A1 | 6/2005 | Olson | |
| 2006/0278205 | A1 | 12/2006 | Axelsson | |
| 2009/0229454 | A1 | 9/2009 | Fluhr et al. | |
| 2010/0071541 | A1 | 3/2010 | Barrett | |
| 2010/0275770 | A1 | 11/2010 | Noveske | |
| 2011/0107900 | A1 | 5/2011 | Presz, Jr. et al. | |
| 2012/0167749 | A1 | 7/2012 | Young | |
| 2012/0167756 | A1 | 7/2012 | Larue | |
| 2012/0167757 | A1 | 7/2012 | Gomez | |

OTHER PUBLICATIONS

Michael O. Humphries, Sig Sauer SIG556 Classic, Aug. 23, 2012, 2 pages, National Rifle Association, http://www.americanrifleman.org/ArticlePage.aspx?id=1661&cid=4.

International Search Report dated Jul. 9, 2014 for International Application No. PCT/US2013/072674 filed Dec. 2, 2013.

Written Opinion dated Jul. 9, 2014 for International Application No. PCT/US2013/072674 filed Dec. 2, 2013.

* cited by examiner

GAS-OPERATED FIREARM WITH PRESSURE COMPENSATING GAS PISTON

CROSS-REFERENCE TO RELATED APPLICATIONS

This application claims the benefit of U.S. Provisional Patent Application No. 61/797,420, filed Dec. 5, 2012.

INCORPORATION BY REFERENCE

The disclosure of U.S. Provisional Patent Application No. 61/797,420, which was filed on Dec. 5, 2012, is hereby incorporated by reference for all purposes as if presented herein in its entirety, for all purposes.

TECHNICAL FIELD

The present invention generally relates to a gas operating system for firearms that allows firing of different cartridge loads for a given shell caliber or gauge.

BACKGROUND INFORMATION

In general, automatic and semiautomatic shotguns can have user-adjustable gas systems that allow a user to control the amount of gas entering into and/or vented from the system. Accordingly, a wider range of cartridge loads can be fired from a single firearm. However, if an adjustable gas system is set for heavy loads and the weapon is used to fire light loads, the firearm may not fully cycle, which may require the user to manually cycle the bolt in order to load the next round. If the adjustable gas system is set for light loads and the weapon is used to fire a heavy load, the bolt velocity after firing may result in improper cycling and the weapon may suffer reduced part life for certain components.

Firearms such as the Remington Model 1187 and Versa-Max Shotguns have self-compensating gas systems. Self-compensating gas systems allow a range of different loads to be fired without requiring adjustment of the gas system. However, the full range of available cartridge loads may not be sufficiently compensated by conventional self-compensating systems. For example, 12 shotshells can vary from 2¾" light loads to 3½" heavy loads. As a result, some self-compensating firearm gas systems may not reliably operate light loads under all conditions, and may suffer undesirably high bolt velocities when firing heavy magnum loads. Additionally, some self-compensating gas systems rely on smaller cartridges, which have a shorter length, having lighter loads and larger, longer length cartridges having heavier loads, but in some cases smaller cartridges can have relatively heavy loads, while longer cartridges may not have a full or anticipated heavy load. In such a case, a system that relies simply on the length of the shotshell or cartridge to compensate for heavier loads might not properly compensate for the heavier load of the shorter cartridge.

SUMMARY OF THE DISCLOSURE

According to one example embodiment of the invention, the present invention generally relates to a pressure compensating system for gas-operated firearms. Such firearms can include shotguns, rifles or other long guns or handguns, and typically can include a receiver, a firing mechanism, a barrel having a firing chamber, one or more gas transmission ports extending through the barrel and opening into the firing chamber, and a gas operating system. The gas operating system can comprise a gas block with at least one pressure compensating gas piston movable along a gas cylinder of the gas block. The gas cylinder defines at least one piston bore in fluid communication with the barrel through the one or more gas transmission ports, which can be arranged as one or more single ports or as groups of ports located at different distances from the chamber end of the barrel. The at least one pressure compensating gas piston generally is at least partially received in its piston bore and comprises a piston body having a relief valve disposed in the interior of the piston body. The relief valve generally can include a movable valve member received within and movable along a valve bore formed in the piston body, and which engages and bears against a biasing member, such as a spring or other biasing element that provides a desired amount of biasing force urging the relief valve toward a closed, first or inactive position. One or more vents can be provided along the valve bore, upstream from the front or open end of the valve bore, for enabling discharge of excess gas through the piston body during a pressure compensation operation.

According to one aspect of the present invention, the firearm is capable of firing different cartridge loads, which may or may not correspond to different cartridge lengths. The one or more ports in the barrel can be arranged so that when shorter, lighter load cartridges are fired, the cartridge casing is short enough so that it does not interfere with, or render "inactive" any of the ports in the barrel. The gases from firing therefore pass unimpeded into the gas operating system to provide the energy needed to drive the action of the firearm. As longer cartridges corresponding to heavier loads are fired, the cartridge case may extend to a sufficient length within the chamber so that one or more of the ports in the barrel are at least partially blocked, obscured, or otherwise rendered "inactive" by the cartridge case. The larger the number of inactive ports, the smaller the percentage of firing gases that are used to cycle the firearm. In the case that a shorter cartridge has a heavier load, but does not render a sufficient number of gas ports inactive to limit the gas pressure communicated to the gas operating system below a desired operating level, the excess gas can cause actuation of the relief valve of the compensating gas piston, by driving the sealing member along the valve bore to a point where the excess gas is bled off through the one or more vents of the valve bore to help reduce the gas pressure acting on the compensating gas piston. Heavier load cartridges are therefore compensated for whether the heavier load is associated with a cartridge length that is sufficient to render an appropriate number of gas ports inactive, or the relief valve bleeds off excess gases in the piston bore.

Other aspects, features, and details of embodiments of the present invention can be more completely understood by reference to the following detailed description of preferred embodiments, taken in conjunction with the drawings figures and from the appended claims.

According to common practice, the various features of the drawings discussed below are not necessarily drawn to scale. Dimensions of various features and elements in the drawings may be expanded or reduced to more clearly illustrate the embodiments of the invention.

BRIEF DESCRIPTION OF THE DRAWING FIGURES

DETAILED DESCRIPTION OF THE EXEMPLARY EMBODIMENTS

Figure 1:
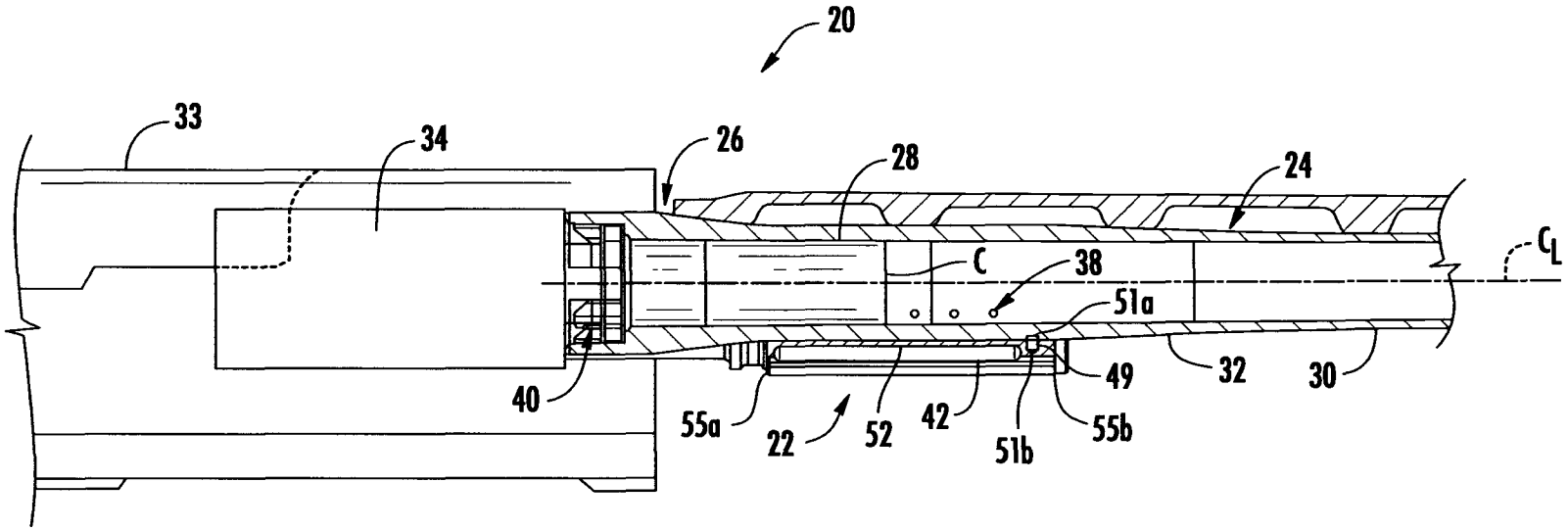
FIG. 1 is a partial sectional schematic view of a firearm having a gas operating system according to an exemplary embodiment of the disclosure.

Referring now to the drawings in which like numerals indicate like parts throughout the several views, FIGS. 1-7 generally illustrate one example embodiment of gas operating system according to the principles of the present disclosure for use in a firearm, such as an autoloading shotgun or other similar type of gas operated firearm. However, it will be understood that the principles of the barrel mounting and retention device of the present invention can be used in various types of firearms including rifles and other long guns, handguns, and other gas-operated firearms such as M4, M16, AR-15, SCAR, AK-47, HK416, ACR and the like. The following description is provided as an enabling teaching of exemplary embodiments; and those skilled in the relevant art will recognize that many changes can be made to the embodiments described. It also will be apparent that some of the desired benefits of the embodiments described can be obtained by selecting some of the features of the embodiments without utilizing other features. Accordingly, those skilled in the art will recognize that many modifications and adaptations to the embodiments described are possible and may even be desirable in certain circumstances, and are a part of the invention. Thus, the following description is provided as illustrative of the principles of the embodiments and not in limitation thereof, since the scope of the invention is defined by the claims.

The invention as exemplified by the embodiment discussed below generally is directed to a gas operating system for autoloading firearms. The gas operating system allows a user to fire different loads for a given cartridge or shell caliber or gauge, while avoiding undesirably high bolt velocities caused by firing excessive or higher pressure loads, while also ensuring that the weapon cycles fully when firing lighter loads. The gas operating system can control the amount of gas tapped from the barrel that is used to operate the firearm action by controlling a number of "active" ports in the firing chamber. An "active" port may be generally defined as a gas bleed port that is at least partially unobstructed by a cartridge case and therefore available to tap gases generated during firing. According to the present invention, the gas ports may be located adjacent or at least partially within the chamber area of the barrel. Cartridge cases of differing sizes and loads can selectively cover and render gas ports inactive according to the lengths of the cartridge cases. Additionally, as shown in the figures, the gas operating system can include a relief valve for relieving excess pressure exerted on a gas piston of the gas operating system during operation of the firearm.

FIG. 1 is a partial sectional view schematically illustrating a gas-operated firearm 20 incorporating a gas operating system 22 according to one embodiment of the invention. The firearm 20 generally includes a barrel 24 having a proximal end 26 with a cartridge firing chamber 28 that is connected with a cylindrical portion 30 of the barrel 24 by a conical constriction portion 32. An example cartridge C is shown chambered within the chamber 28. While the cartridge C is generally illustrated as a shotshell, other types of ammunition cartridges also can be used with the gas operating system of the present invention. The barrel 24 and the gas operating system 22 can be mounted to a forward end of a receiver 33 so that the chamber 28 of the barrel 24 and a portion of the gas operating system are in communication with a bolt 34. The bolt 34 is translatable along the receiver 33 in response to actuation of the gas operating system 22, to cause the bolt to translate along the receiver, for ejecting a spent shell casing from the firearm, and thereafter will be pushed forwardly along the receiver to load a new cartridge from a magazine (not shown) into the chamber 28. In the exemplary illustrated embodiment, the bolt 34 has a rotating head 40 which may be, for example, of the type described in U.S. Pat. No. 4,604,942, the disclosure of which is hereby incorporated by reference as if presented herein in its entirety. The bolt and receiver also could be otherwise shaped, arranged, and/or configured without departing from the disclosure.

Figure 6A:
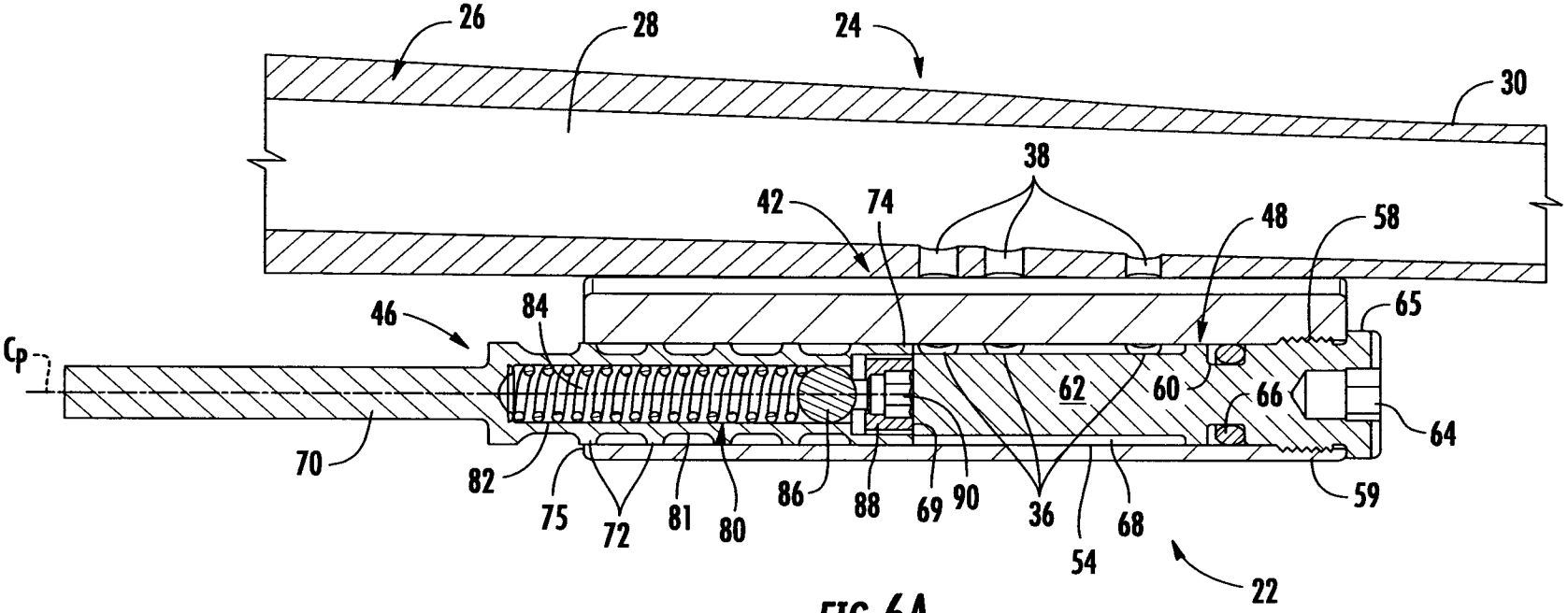
FIG. 6A is a longitudinal cross-sectional view of the gas operating system of FIG. 4 with the barrel of FIG. 1 schematically shown in cross-section.

Actuation and operation of the gas operating system 22 is driven by combustion gases from firing of the cartridge. These gases are supplied to the gas operating system from a plurality of gas transmission ports formed in the gas operating system and along the barrel 24, collectively indicated by the reference numbers 36 and 38, respectively (see FIGS. 1, 4 and 6A). As schematically indicated in FIG. 6A, each of the gas transmission ports 36 of the gas operating system 22 generally can be aligned with a corresponding one of the ports 38 in the barrel 24. Alternatively, the barrel and the gas operating system can have different numbers of gas transmission ports. The gas transmission ports 36, 38 allow gases generated during firing to be tapped from the chamber 28 and directed to the gas operating system 22 to cycle the firearm 20 (FIG. 1). The gas transmission ports 36, 38 could be otherwise shaped, arranged, and/or configured without departing from the disclosure. For example, in one embodiment, the barrel could have two gas transmission ports 38 that are aligned with respective gas transmission ports 36 of the gas operating system, and additional gas ports 36 in the gas operating system are closed off by the exterior surface of the barrel 24.

Figure 2:
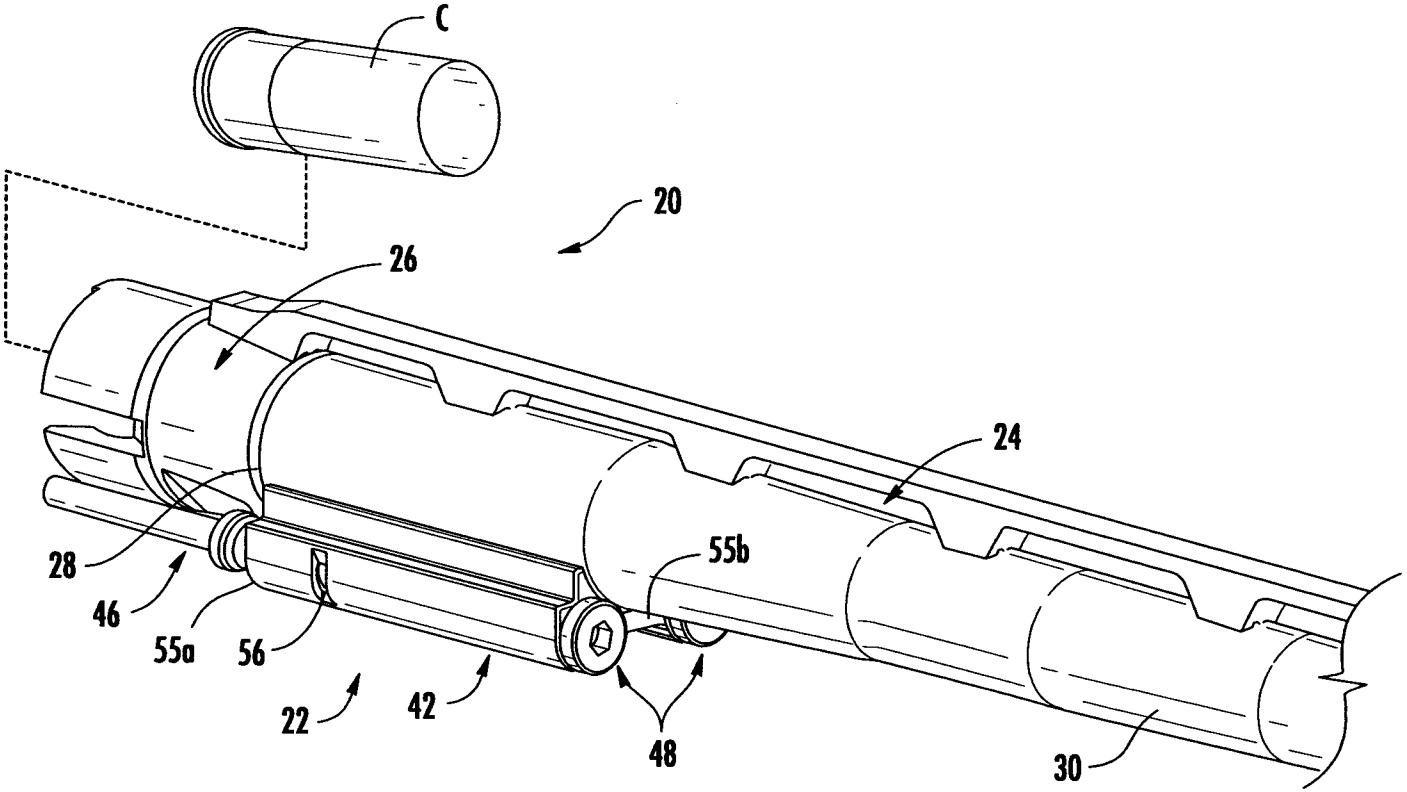
FIGS. 2 and 3 are isometric views of the gas operating system and a barrel of the firearm of FIG. 1.
Figure 3:
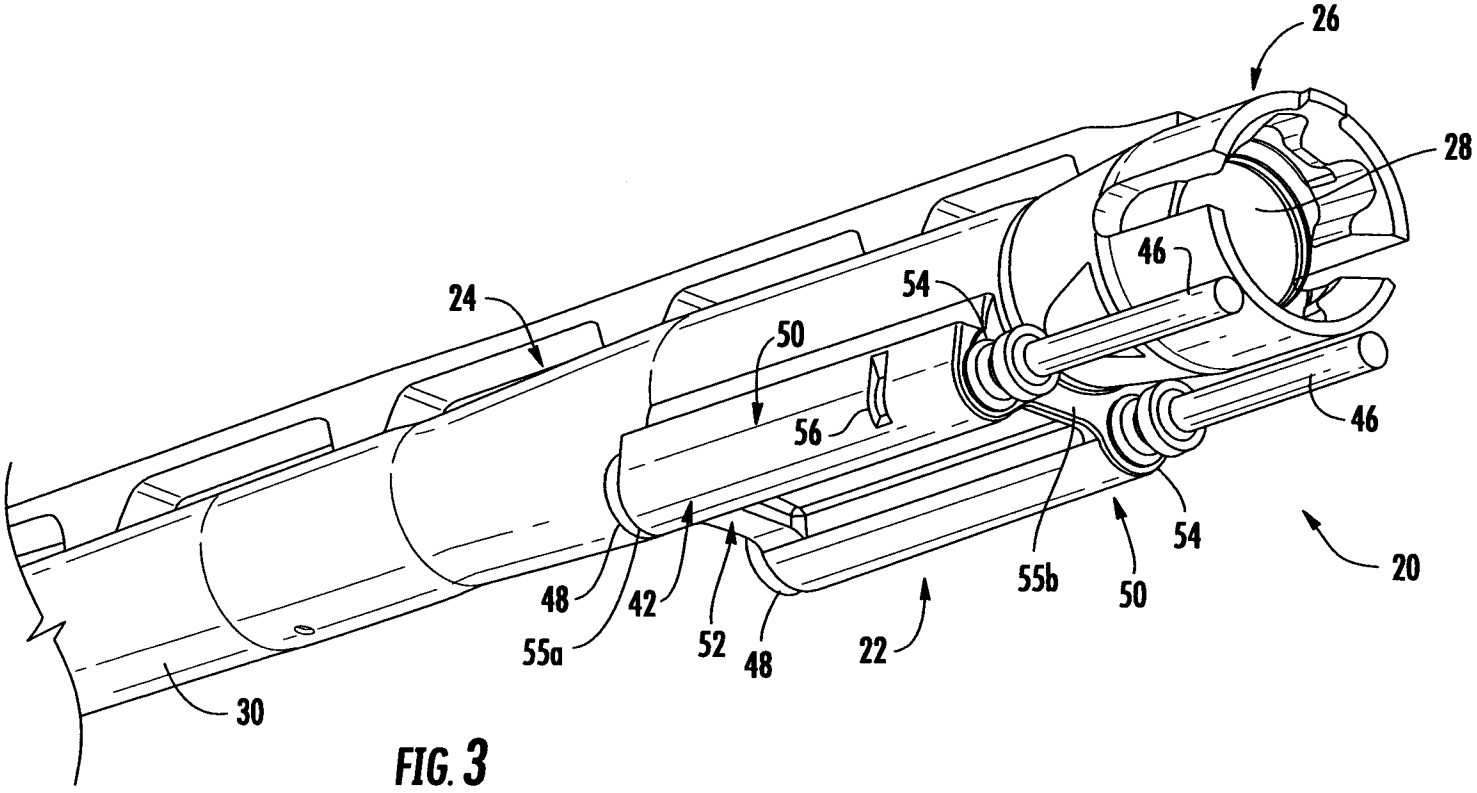

The barrel 24 and the gas operating system 22 are further shown in FIGS. 2 and 3. In the illustrated embodiment, the gas operating system 22 includes a gas cylinder or gas block 42 with a concave upper surface 44 (FIGS. 4 and 5), and a pair of compensating gas pistons 46, with gas cylinder plugs 48 at a front or downstream end of the gas block. The underside of the proximal end 26 of the barrel 24 rests on the concave upper surface 44 of the gas block 42, with the gas block 42 being mounted, brazed or otherwise attached to the underside of the barrel 24, with at least some or all of the gas transmission ports 36, 38 aligned and in fluid communication. In one embodiment, an alignment pin 49 (FIG. 1) can be received in corresponding recesses or bores 51*a*/51*b* in the exterior surface of the barrel 24 and the concave upper surface 44 of the gas block 42 to help position the gas block along the exterior surface of the barrel so that the gas transmission ports 36, 38 are properly aligned. Alternatively, the gas block 42 could be otherwise affixed to the barrel or integrally formed with the barrel.

Figure 4:
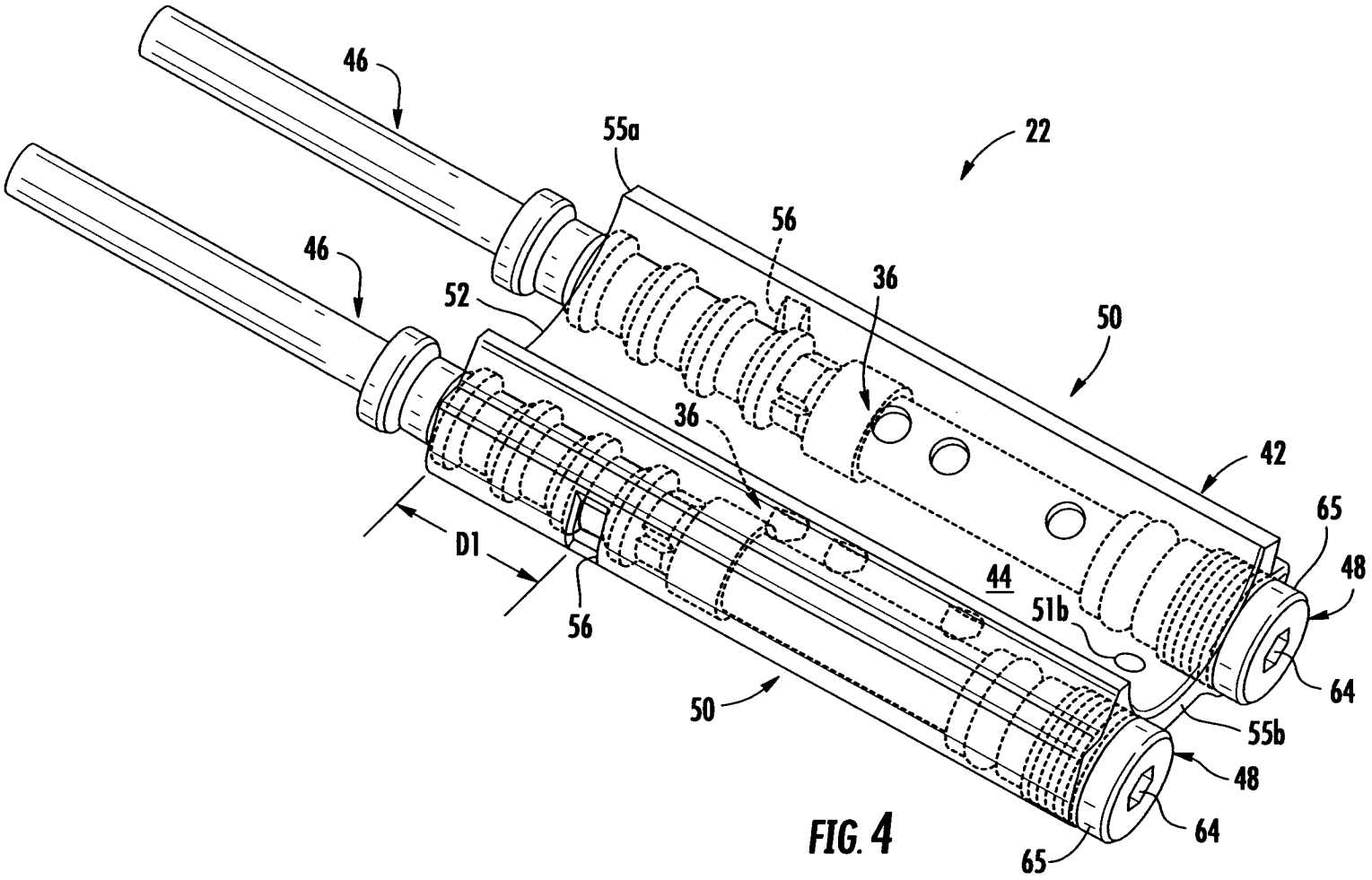
FIG. 4 is an isometric view of the gas operating system with the portions of the gas operating system inside the gas block shown in phantom according to the exemplary embodiment of the disclosure.
Figure 5:
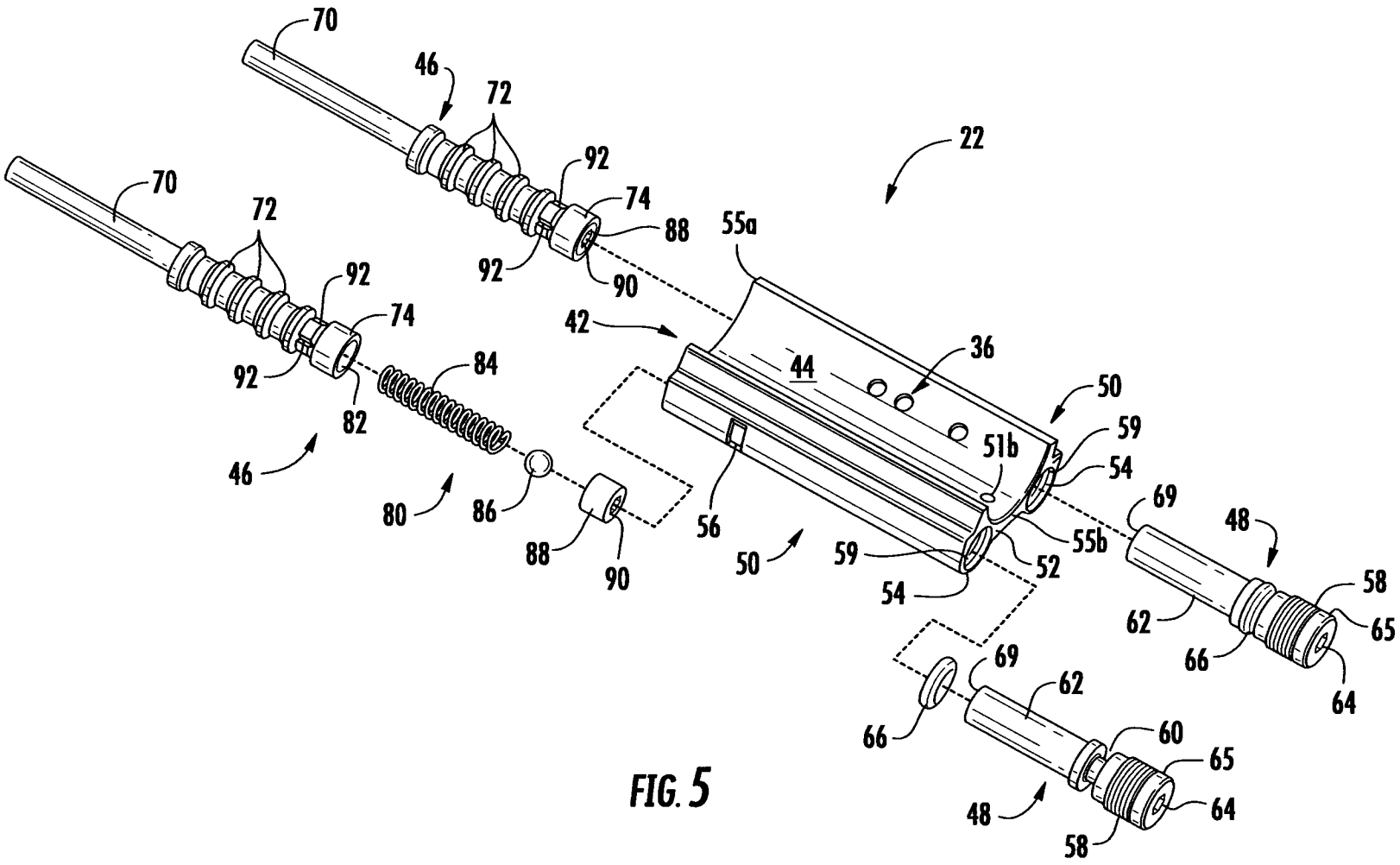
FIG. 5 is an exploded isometric view of the gas operating system of FIG. 4.

As shown in FIGS. 4 and 5, the gas block 42 can include a pair of longitudinal sections 50 that are laterally spaced by a central section 52. In the illustrated embodiment, the longitudinal sections 50 generally are mirror images of one another. Each of the longitudinal sections 50 includes a longitudinal piston bore 54 for receiving a movable pressure compensating gas piston 46 therealong, and which may be sealed at its forward end by a gas cylinder plug 48. Other alternative arrangements for enclosing the piston bores of the gas block also can be used, for example, a diverter cap having a tapered or otherwise shaped base or stem, which can further include one or more gaskets to help seal the piston bores. Alternatively, the piston bores could be blind bores formed from the rear face 55*a* of the gas block so that an integral wall of the gas block 42 at the forward end 55*b* of the gas block 42 seals the forward ends of the piston bores. Each of the piston bores 54 is in communication with the gas transmission ports 36, which are aligned in the longitudinal direction in the illustrated embodiment. Alternatively, the piston bores 54 can be in communication with any suitable number of gas transmission ports 36, and the gas transmission ports can be otherwise arranged without departing from the disclosure. Each of the piston bores 54 also can be in communication with a relief vent 56 (FIGS. 3 and 4) proximate to the rear ends of the longitudinal sections 50. In the illustrated embodiment, the relief vents 56 can be spaced a distance D1 from the rear end of the gas block 42 (FIG. 4). The gas block 42 could be otherwise shaped, arranged, and/or configured without departing from the disclosure.

According to one aspect of the invention, the plurality of gas transmission ports 36 in the gas block 42 are in fluid communication with the plurality of gas transmission ports 38 in the barrel 24 (e.g., see FIG. 6A), and allow cartridge loads of different "strength" to be fired from the firearm 20. A firearm configured so that cartridge casings of different lengths and corresponding load strengths affect the number of active gas transmission ports in the barrel is described in U.S. Pat. No. 8,065,949, the disclosure of which is hereby incorporated by reference as if presented herein in its entirety. For example, a relatively longer cartridge with a larger load can at least partially cover one or more of the gas transmission ports 38 upon firing of the firearm 20, while a shorter cartridge with a smaller load generally may not cover any of the gas transmission ports 38 in the barrel 24. Closing selected gas transmission ports 36, 38 restricts gas flow from the barrel 24 to the gas block 42 when the longer cartridge is fired to help compensate for the higher gas pressure resulting from the larger load of the longer cartridge. Accordingly, longer cartridge casings can render one or more gas transmission ports 38 inactive. An inactive gas port is either wholly or partially ineffective in transmitting gases generated during firing to the piston bores 54, and therefore may not fully contribute to the rearward forces on the compensating gas pistons 46 that force the bolt rearwardly.

As shown in FIGS. 4, 5, and 6A, the gas transmission ports 36 are arranged along the length of the longitudinal sections 50 of the gas block 42 and generally extend through the cylinder from the concave upper surface 44 to the piston bores 54. The outlines of the respective gas transmission ports 36 in each of the longitudinal sections 50 are shown in phantom in FIG. 4. In the illustrated embodiment, the gas transmission ports 36 extend generally radially from the concave upper surface 44 to be in fluid communication with the respective piston bores 54. Alternatively, the gas transmission ports 36 may be formed in the gas block 42 at various angular orientations. As shown schematically in FIG. 6A, the gas transmission ports 38 are aligned with the gas transmission ports 36 in the gas block 42 and extend through the wall of the barrel 24 to be in fluid communication with the chamber 28. In one embodiment, the gas transmission ports 38 can extend at an angle with respect to the radial direction in the illustrated embodiment. For example, the gas transmission ports 38 can extend generally rearwardly from the interior surface of the barrel 24 to the exterior surface of the barrel. Alternatively, the gas transmission ports 38 can extend at any suitable angle. The gas transmission ports 36, 38 could be otherwise shaped, arranged, and/or configured without departing from the disclosure. For example, any number, combination, and/or arrangement of gas transmission ports may be formed in the barrel and the gas block in order to accommodate firing of a wide variety of cartridge loads.

In the illustrated embodiment, each of the gas cylinder plugs 48 is received in the respective piston bores 54 at the forward end of the gas block 42. As shown in FIG. 5, each gas cylinder plug 48 includes a threaded head 58, an O-ring seat 60, and a diverter portion 62. The threaded head 58 can be threaded for being threadedly engaged with a threaded portion 59 of the piston bore 54 at the forward end 55*b* of the gas block (FIG. 6A). Additionally, as shown in FIG. 4, the head can include a socket 64 for engaging a hex key or other tool. The O-ring seat 60 comprises an annular recess for receiving an O-ring 66 or other sealing feature that helps to seal the piston bores 54 at the forward end of the gas block 42 (FIG. 6A). The threaded head 58 can have a diameter that is a relatively close fit in the piston bore 54 and a larger cap portion 65 that engages the forward surface 55*b* of the gas block 42 when the gas cylinder plug 48 is fully screwed into the forward end 59 of the piston bore 54.

As shown in FIGS. 4, 5, and 6A, the diverter portion 62 is generally cylindrical with a smaller diameter than the piston bore 54, forming an annular space 68 (FIG. 6A) between the interior surface of the piston bore 54 and the exterior surface of the diverter portion 62. As shown in FIG. 6A, the diverter portion 62 extends into the piston bore 54 past the gas transmission ports 36 so that the annular space 68 is in fluid communication with the gas transmission ports 36, thus enabling the gases to flow along the diverter portion 62 and into contact/driving engagement with the piston 46. Additionally, a rearward stop end 69 of the diverter portion 62 provides a forward stop for the compensating gas piston 46 in the piston bore 54 that is to the rear of the gas transmission ports 36. Accordingly, in one embodiment, the compensating gas piston 46 will not block the gas transmission ports 36. The gas cylinder plug 48 could be otherwise shaped, arranged, and/or configured without departing from the disclosure. For example, the diverter portion 62 could have a frustoconical shape or any other suitable shape, or the diverter portion 62 could be omitted.

As shown in FIG. 5, the compensating gas pistons 46 each include an elongate cylindrical piston body 70 having a plurality of spaced annular cleaning ribs 72 and a head 74. The compensating gas pistons 46 are received and longitudinally translatable within a rear end 75 of the respective piston bores 54 and are biased toward the stop end 69 of the diverter portion 62 of the gas cylinder plug 48 (FIG. 6A) by a spring (not shown), for example. The piston head 74 can be sized for a snug, slidable fit in the piston bore 54 so that little or no gas can move between the piston head 74 and the inner surface of the piston bore 54. As schematically shown in FIG. 1, the piston body 70 is in communication with the forward end of the bolt 34 in the receiver 33 so that the bolt is actuated when the compensating gas pistons 46 translate rearwardly.

In the illustrated embodiment, each of the compensating gas pistons 46 includes an internal pressure relief valve 80 to help reduce excess pressure on the piston head 74 in the respective piston bore 54. As shown in FIGS. 5 and 6A, each compensating gas piston 46 comprises a valve housing 81 extending from the piston head 74. The valve housing 81 of the piston body 70 defines a longitudinal valve bore or passage 82 that receives a valve spring 84, a movable valve member 86 (here shown as a ball bearing), and an orifice bushing 88. Accordingly, the respective piston bodies 70 of the compensating gas pistons 46 act as housings for the respective relief valves 80. The orifice bushing 88 is received in the valve bore 82 at the head 74 of the compensating gas piston 46 and defines a valve inlet 90 in fluid communication with the piston bore 54 and the valve bore 82 when the internal relief valve 80 is open. In one embodiment, the valve inlet 90 is generally aligned with a longitudinal axis CP of the valve bore 82 and the piston body 70 (FIG. 6A). The orifice bushing 88 can be threadedly or otherwise releasably engaged with the valve bore 82 so that the orifice bushing can be removed. A hex socket or another suitable feature also can be incorporated into the valve inlet 90 to facilitate tightening the orifice bushing 88 in the valve bore with a tool (not shown). Alternatively, the orifice bushing could be press fit and/or secured with adhesive in the valve bore 82.

Figure 6B:
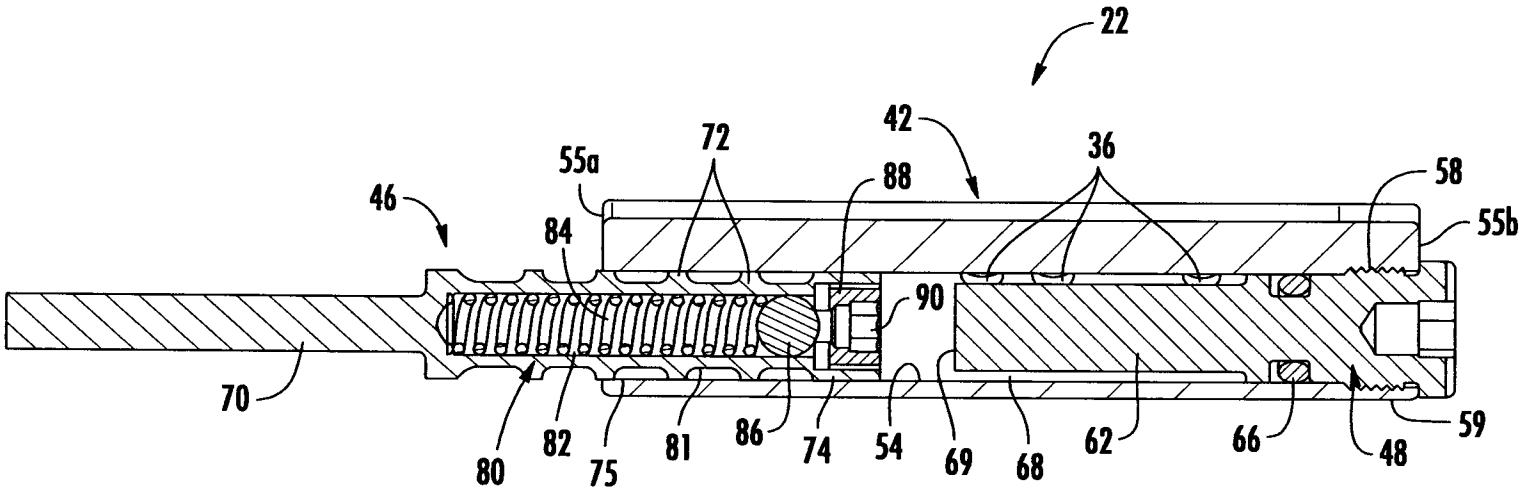
FIGS. 6B and 6C are longitudinal cross-sectional views of the gas operating system illustrating operation of the gas operating system during respective firing cycles.
Figure 6C:
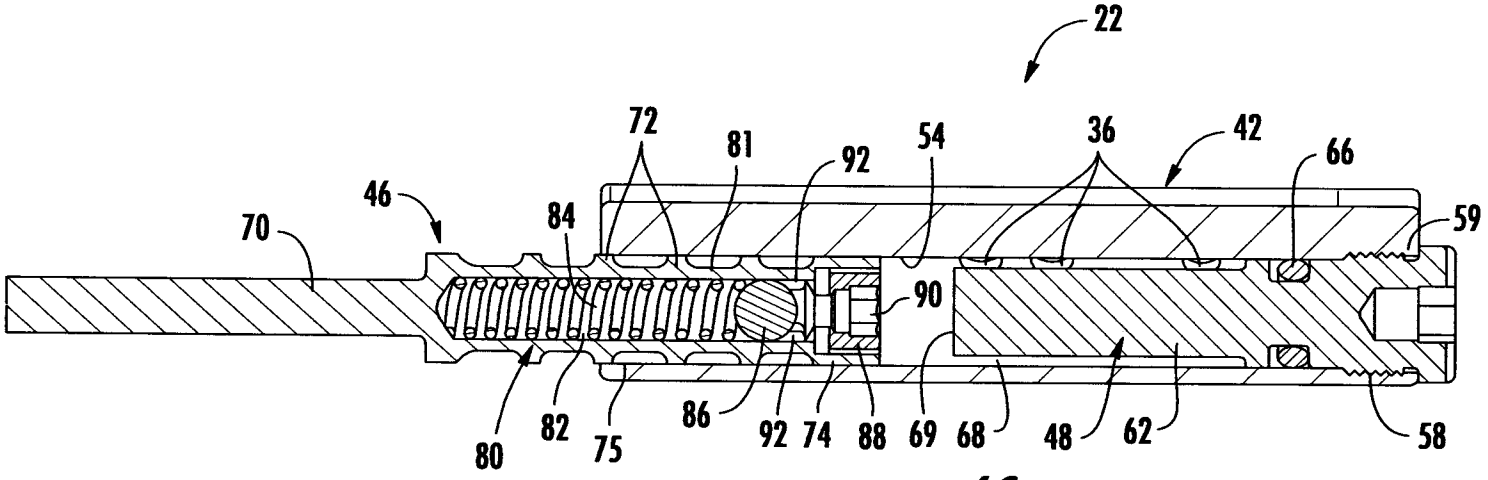

As shown in FIGS. 6A-6C, the valve member 86 and the valve spring 84 are movable along the valve bore 82 during operation, and further can be removable from the valve bore when the orifice bushing 88 is removed (FIG. 5) for cleaning the valve bore 82 and/or replacing the valve member 86, the valve spring 84, and/or the orifice bushing 88. In addition, while the relief valve has been illustrated in the drawings as including a ball moving against the spring, it will be understood that other constructions also can be used. For example, the valve member could comprise a piston rod or other similar member movable along the valve bore in bearing engagement with a spring, diaphragm, or other bearing member.

Figure 7:
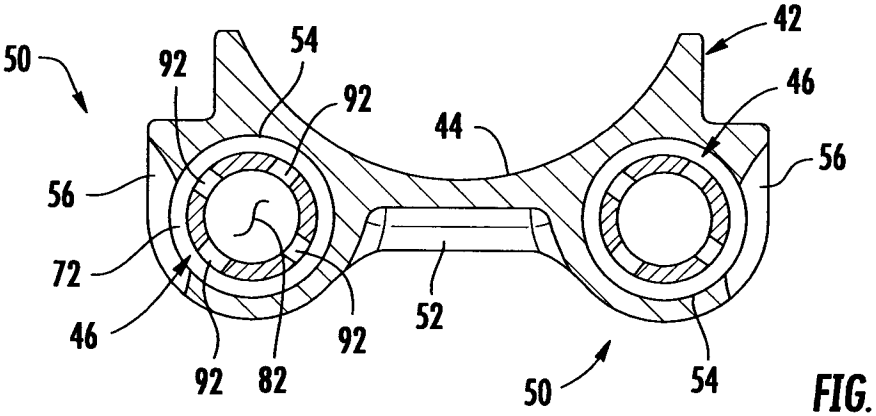
FIG. 7 is a transverse cross-sectional view of the gas operating system illustrating operation of the gas operating system during a firing cycle.

As shown in FIGS. 5, 6C, and 7, the relief valve 80 can include a series of outlet slots 92 (here shown as 4 outlet slots although less or more slots or other outlets can be used) formed in the housing 81. The outlet slots 92 are in communication with the valve bore 82 and disposed between the head 74 of the compensating gas piston 46 and the forward annular rib 72. As shown in FIG. 6A, the valve spring 84 biases the valve member 86 forwardly in the valve bore 82 against the orifice bushing 88 to block the valve inlet 90. When excess gas pressure in the piston bore 54 rises to a level sufficient to overcome the spring force of the valve spring 84, the gases urge the valve member 86 rearwardly away from the orifice bushing 88. This opens the valve bore 82 to passage of the gases through the valve inlet 90 into the valve bore 82, and then out through the outlet slots 92 into the portion of the piston bore 54 that is to the rear of the head 74 of the compensating gas piston 46 as indicated in FIG. 6C. As each pressure compensating gas piston 46 likewise is moved rearwardly along its piston bore 54, the outlet slots 92 can be brought into fluid communication with the relief vent 56 of the gas block 42 (FIG. 7), whereby the excess gases can escape from the gas block. The compensating gas pistons 46 and/or the relief valves 80 could be omitted or otherwise shaped, arranged, and/or configured without departing from the disclosure. For example, the ball bearing 86 could be replaced with any suitable poppet or piston having any suitable shape, such as a cylindrical, hemispherical, conical, frustoconical, etc.

In the illustrated embodiment, the compensating gas pistons 46 provide relief valves 80 without adding bulk to the gas operating system 22. Additionally, the gas operating system 22 can be easily disassembled by removing the gas cylinder plugs 48 and the compensating gas pistons 46 from the piston bores 54. In one embodiment, each of the gas cylinder plugs 48 is easy to remove, such as with the hex key, so that the gas cylinder plugs 48 and the compensating gas pistons 46 can be removed from the respective piston bores 54 through the forward ends 59 of the piston bores without disassembling the gas block 42 from the barrel 24. Accordingly, the gas cylinder plugs 48, the compensating gas pistons 46, and/or the piston bores 54 can be cleaned and/or the gas cylinder plugs 48 and/or the compensating gas pistons 46 can be replaced without disassembling other portions of the firearm.

In operation, a shell C is loaded into the chamber 28 and the bolt 34 is closed, chambering the shell C as shown in FIG. 1. The bolt head 40 locks to the barrel 24 and helps to secure the cartridge C in the chamber 28 after the shell C is fired. Generally, the shell C is fired by activating a firing mechanism, such as by pulling a trigger to release a striker, which in turn hits the cartridge primer (not shown). The primer is ignited and in turn ignites the main powder charge in the shell C. As pressure builds in the cartridge case and the chamber 28, a wad and shot column of the shell C travels down the barrel 24.

As the shot column travels down the barrel 24, a percentage of the high pressure firing gases in the barrel 24 is tapped and is introduced into the gas block 42. In one embodiment, when the cartridge C is fired, the case of the cartridge C assumes an extended form (not shown) as the cartridge casing unrolls. In one example, the extended cartridge form may not cover or otherwise at least partially obstruct any of the ports 38 in the barrel 24. All ports 38 therefore remain active to transmit gases through the respective gas transmission ports 36 in the gas block 42. The gases transmitted through the gas transmission ports 36 are transmitted into the piston bores 54 and force the compensating gas pistons 46 rearward against the bolt 34. The gases generated during firing are therefore able to flow through all of the ports 36, 38 (i.e., all ports are active) to the compensating gas pistons 46 in the piston bores 54, which provides the energy to unlock the bolt 34 and to propel the bolt rearwardly in the receiver.

As the bolt 34 travels rearwardly, the spent case C is pulled from the chamber 28 and ejected from the firearm 20. The bolt 34 travels to the rear of the receiver 33, which also compresses an action spring (not shown). If a next shell is present, such as from a magazine, the bolt 34 is released from the rear position and is propelled forward by the stored energy in the action spring. As the bolt 34 travels back toward the barrel 24, the new shell is fed into the chamber 28 and the bolt head 40 locks to the barrel 24. The cycle repeats when the trigger is again pulled.

In another example, when a longer cartridge (not shown) generally corresponding to a heavier load shell is loaded into the chamber 28, and is fired, the case of the longer cartridge can at least partially cover one or more of the ports 38 in the barrel 24, rendering them inactive. The gases generated during firing are therefore either wholly or partially blocked from passing into the gas block 42 through the corresponding ports 36 in the gas block 42 that are aligned with the inactive gas ports 38. The gas transmission ports 38 that are farther down the barrel 24 remain active, and the firing gases are allowed to pass through the corresponding ports 36 and into the piston bores 54. The gases transmitted to the piston bores 54 provide the energy required to force the compensating gas pistons 46 rearwardly to cycle the firearm 20, as discussed above. However, having fewer active gas ports 38 can help to compensate for the additional firing gases that may be produced by a heavier load shell.

In some cases, the cartridge load strength may not correlate with the length of the cartridge. For example, a relatively short cartridge can have a relatively large load strength and can produce higher gas pressure in the chamber 28 than desired for operation of the gas operating system 22 while the short length of the cartridge might not cover the gas transmission ports 38 upon firing. Accordingly, a relatively high gas pressure can be communicated through the gas transmission ports 36, 38 to the piston bores 54 and drive the compensating gas pistons 46 rearward with more force than desired. However, the relief valves 80 in the compensating gas pistons 46 can help excess gases to escape from the piston bores 54 through the respective piston bodies 70 to reduce the forces on the respective heads 74 of the pressure compensating gas pistons.

Particularly, for each of the longitudinal sections 50, the gases flow from the gas transmission ports 36 and enter the annular space 68 between the diverter portion 62 of the gas cylinder plug 48 and the interior surface of the piston bore 54. As shown in FIG. 6A, the compensating gas piston 46 is biased against the stop end 69 of the diverter portion 62, and the piston head 74 blocks the gases from passing to the rear of the diverter portion 62 in the piston bore 54. Additionally, the threaded head 58 of the gas cylinder plug 48 and the O-ring 66 can generally seal off the forward end 59 of the piston bore 54 so that gases flowing into the piston bore 54 through the gas transmission ports 36 build up in the annular space 68. As the pressure in the annular space 68 increases, the gases push against the head 74 to push the compensating gas piston 46 rearward. As the head 74 moves away from the rear end of the gas cylinder plug 48, the gases can flow into the valve inlet 90 and push against the valve member 86. If the gas pressure is below a desired operating pressure for the firearm (e.g., a gas pressure that is selected to be low enough to help avoid undue wear and/or misalignment of the bolt 34, receiver 33, compensating gas pistons 46, and/or other features of the firearm), the pressure does not overcome the spring force of the valve spring 84 and the valve member 86 remains seated against the orifice bushing 88. Accordingly, the gas pressure can force the piston head 74 rearward so that the compensating gas piston 46 moves rearward in the piston bore 54 as shown in FIG. 6B.

In the illustrated embodiment, the piston body 70 moves rearwardly out of the piston bore 54 and into the receiver 33 (FIG. 1) to actuate the bolt 34. In one embodiment, the piston head 74 remains in the piston bore 54 through the length of travel of the compensating gas piston 46. In one embodiment, the piston head 74 is disposed forwardly of the relief slot 56 in the piston bore 54 when the compensating gas piston 46 stops retracting (e.g., when the bolt 34 is fully retracted in the receiver 33). Accordingly, the piston head 74 does not block the relief vent 56. When the compensating gas piston 46 is returned to the position of FIG. 6A with the piston head 74 abutting the stop end 69 (e.g., by the bolt 34 or by a biasing spring, not shown), the gases remaining in the piston bore 54 can be exhausted through the gas transmission ports 36, 38. In another embodiment, the piston head 74 can translate to a position that is to the rear of the relief vent 56 when the compensating gas piston 46 is in its rearmost position. Accordingly, gases in the piston bore 54 can exit the piston bore through the relief vent before the compensating gas piston 46 is returned to the position of FIG. 6A.

If the pressure of the gases acting on one or both of the gas compensating pistons 46 is above a predetermined, desired operating pressure, once the gas pressure forces the respective gas compensating piston 46 rearwardly so that the piston head 74 moves away from the stop end 69 of the gas cylinder plug 48, the gas pressure on the valve member 86 overcomes the spring force of the valve spring 84 and the valve member 86 is moved away from the orifice bushing 88 in the valve bore 82 as shown in FIG. 6C. The excess gases then can flow through the valve inlet 90 into the valve bore 82 until the pressure on the valve member 86 decreases to the desired operating pressure and the valve spring 84 forces the valve member against the orifice bushing 88 to close the valve inlet 90 (FIGS. 6A and 6B). With the relief valve 80 open, the gases can escape the valve bore 82 through the outlet slots 92 into the portion of the piston bore 54 behind the head 74, and the excess gases can escape the piston bore through the relief slots 56 (FIG. 7).

In the illustrated embodiment, the gas operating system 22 includes two compensating gas pistons 46. In a different embodiment, one or both of the compensating gas pistons 46 could be otherwise configured (e.g., the internal relief valve 80 could be omitted). Additionally, the gas operating system could comprise any suitable number of compensating gas pistons 46 or other pistons, and the gas block 42 could include a corresponding number of longitudinal sections 50 and piston bores 54 without departing from the disclosure. Other features of the gas operating system 22 and the firearm 20 could be otherwise shaped, arranged, and/or configured without departing from the disclosure.

According to one aspect of the present invention, the gas operating system renders a firearm capable of firing a wide range of shot loads without requiring active adjustment of the firearm. The gases transmitted for cycling the firearm are instead passively or automatically adjusted for according to the length of the shell casing. Any number and/or combination of ports may be formed in the barrel, and corresponding ports formed in the gas cylinder, in order to accommodate firing of a wide variety of cartridge loads. Additionally, the gas operating system compensates for high shot loads regardless of the length of the shell casing. The relief valves help to reduce gas pressure in the gas operating system by bleeding off excess gas while being conveniently interior to the gas pistons.

Those skilled in the art will appreciate that many modifications to the exemplary embodiments are possible without departing from the scope of the invention. In addition, it is possible to use some of the features of the embodiments described without the corresponding use of the other features. Accordingly, the foregoing description of the exemplary embodiments is provided for the purpose of illustrating the principle of the invention, and not in limitation thereof, since the scope of the invention is defined solely be the appended claims.

What is claimed is:

1. A gas operating system for a firearm, comprising:

a gas block comprising a longitudinal piston bore;

a compensating gas piston at least partially disposed in the longitudinal piston bore, the compensating gas piston comprising a piston body that is movable along the longitudinal piston bore, a gas pressure relief valve disposed internally within the piston body; and a diverter portion extending into the longitudinal piston bore, wherein the compensating gas piston is movable along the longitudinal piston bore to selectively contact a stop end of the diverter portion;

wherein as the piston moves along the piston bore in response to the pressurized gases from firing entering the piston bore, the relief valve of the piston enables excess gases to be diverted through the piston body to reduce pressure acting on the piston and reduces bolt velocity during cycling of the bolt.

2. The gas operating system of claim 1, wherein the gas pressure relief valve comprises a valve housing, a valve bore at least partially defined by the valve housing and extending along the piston body, and a valve member disposed in the valve bore, the valve member being movable within the valve bore.

3. The gas operating system of claim 2, wherein the gas pressure relief valve comprises a valve inlet extending in the valve housing, the valve inlet being in fluid communication with the valve bore and the longitudinal piston bore via a forward end of the piston body, the valve member being biased against the valve inlet to at least partially close the valve inlet.

4. The gas operating system of claim 3, wherein the compensating gas piston comprises a piston head in slidable engagement with the longitudinal piston bore of the gas block, and wherein the valve inlet of the gas pressure relief valve extends through the piston head.

5. The gas operating system of claim 4, wherein the valve inlet and the valve bore generally are aligned along a longitudinal axis of the piston body.

6. The gas operating system of claim 3, wherein the valve member is biased against the valve inlet by a spring disposed in the valve bore of the valve housing.

7. The gas operating system of claim 2, wherein the gas pressure relief valve comprises an outlet formed along the valve housing of the piston body at a location rearward spaced from a piston head, wherein the outlet is in fluid communication with the valve bore of the valve housing and the longitudinal piston bore of the gas block, the gas block further comprising a relief vent in fluid communication with the outlet of the gas pressure relief valve.

8. The gas operating system of claim 2, wherein the valve housing further comprises a plurality of outlet slots extending through the valve housing between the valve bore of the valve housing and the longitudinal piston bore.

9. The gas operating system of claim 2, wherein the compensating gas piston comprises a piston head in slidable engagement with the longitudinal piston bore of the gas block, the piston head comprises an axial bore in communication with the valve bore at the valve housing, the compensating gas piston further comprises an orifice bushing removably secured in the axial bore of the piston head, and the gas pressure relief valve comprises a valve inlet that extends through the orifice bushing.

10. The gas operating system of claim 1, further comprising a gas plug at least partially sealing a forward end of the longitudinal piston bore of the gas block.

11. The gas operating system of claim 10, wherein the diverter portion of the gas plug at least partially defines an annular space in the longitudinal piston bore, and the gas block comprises a series of gas transmission ports in fluid communication with the annular space in the longitudinal piston bore.

12. A gas operating system for a firearm, comprising:

a gas block comprising a longitudinal piston bore;

a compensating gas piston at least partially disposed in the longitudinal piston bore, the compensating gas piston comprising a piston body that is movable along the longitudinal piston bore, and a gas pressure relief valve disposed internally within the piston body;

wherein as the piston moves along the piston bore in response to the pressurized gases from firing entering the piston bore, the relief valve of the piston enables excess gases to be diverted through the piston body to reduce pressure acting on the piston and reduces bolt velocity during cycling of the bolt;

wherein the longitudinal piston bore comprises a first longitudinal piston bore, extending along the gas block, and the gas block further comprises a second piston bore laterally spaced from the first longitudinal piston bore; and the gas operating system further comprises a second compensating gas piston at least partially disposed in the second longitudinal piston bore and a second gas pressure relief valve disposed internally within the second compensating gas piston.

13. A firearm, comprising:

a receiver;

a firing mechanism;

a barrel having a firing chamber;

at least one barrel port extending through the barrel;

a bolt;

a gas operating system adjacent the barrel comprising:

a gas block comprising a piston bore and at least one gas block port in fluid communication with the piston bore and the at least one barrel port to enable passage of pressurized gases from firing to pass into the piston bore;

a compensating gas piston at least partially disposed in the piston bore and comprising a piston body that is movable within the piston bore; and a relief valve disposed internally within the piston body and including a valve member and at least one outlet, the at least one outlet extending through the piston body and communicating with the piston bore to enable gases to flow through the piston body;

wherein as the piston moves along the piston bore in response to the pressurized gases from firing entering the piston bore, the relief valve of the piston enables excess gases to be diverted through the piston body to reduce pressure acting on the piston and reduces bolt velocity during cycling of the bolt.

14. The firearm of claim 13, wherein the relief valve comprises a valve housing, a valve bore at least partially defined by the valve housing and extending along the piston body, and a valve member movable along the valve bore in response to the excess gases engaging the compensating gas piston exceeding a predetermined level.

15. The firearm of claim 13, wherein the relief valve comprises a valve housing, a valve inlet at a first end of the valve housing, the valve inlet being in fluid communication with the valve bore of the valve housing and the piston bore of the gas block, and a valve member movable along the valve housing and biased against the valve inlet to at least partially close the valve inlet.

16. The firearm of claim 15, wherein the at least one outlet of the relief valve is disposed at a second end of the valve housing spaced rearward from the valve inlet, the at least one outlet of the relief valve being in fluid communication with the valve bore, and wherein the gas block further comprises a relief vent for release of excess gases diverted through the at least one outlet of the relief valve.

17. The firearm of claim 13, further comprising a gas plug at least partially sealing a forward end of the piston bore, wherein the gas plug comprises a diverter portion projecting into the longitudinal piston bore, and wherein the compensating gas piston is movable along the piston bore to selectively contact a stop end of the diverter portion.

18. The firearm of claim 13, wherein the at least one barrel port comprises a plurality of barrel ports that are longitudinally spaced along the barrel, the at least one gas block port comprises a plurality of gas block ports that are longitudinally spaced along the piston bore, and each gas block port of the plurality of gas block ports generally is aligned with respective barrel ports of the plurality of barrel ports.

* * * * *